United States Patent [19]

Pohl et al.

[11] 3,967,489

[45] July 6, 1976

[54] METHOD OF FORMING CONSTRICTION IN TUBING

[75] Inventors: Walter John Pohl, Anchorage; Roy W. Abbott, Louisville, both of Ky.

[73] Assignee: General Electric Company, Louisville, Ky.

[22] Filed: May 15, 1975

[21] Appl. No.: 577,710

[52] U.S. Cl. ..... 72/367; 29/157 R; 62/511

[51] Int. Cl.[2] ..... B21B 51/16

[58] Field of Search ..... 72/30, 57, 367; 62/511, 62/527, 528; 138/44; 29/157 R, 157 C, 404; 73/418

[56] References Cited

UNITED STATES PATENTS

| | | | |
|---|---|---|---|
| 2,075,921 | 4/1937 | Winkler et al. | 72/57 |
| 2,791,239 | 5/1957 | Mason | 62/527 |
| 2,950,608 | 8/1960 | Abbott | 62/511 |
| 3,311,131 | 3/1967 | Zahurawec | 62/511 |
| 3,362,061 | 1/1968 | Krasnitz | 29/157 |
| 3,866,448 | 2/1975 | Dennis et al. | 72/30 |

*Primary Examiner*—Lowell A. Larson
*Attorney, Agent, or Firm*—Frank P. Giacalone; Francis H. Boos

[57] ABSTRACT

The present invention provides a method of forming a flow restriction in a tube to be used as a capillary in a refrigeration system. The method includes shaping the tube longitudinally to a preselected configuration, and then squeezing a section of the tube while directing a fluid therethrough until the fluid reaches a preselected pressure.

2 Claims, 5 Drawing Figures

METHOD OF FORMING CONSTRICTION IN TUBING

BACKGROUND OF THE INVENTION

1. Field of the Invention

The present invention relates generally to the process of manufacturing a capillary tube for use in a refrigeration system, and more specifically, to the process of shaping a length of tube longitudinally to a preselected axial configuration, and then squeezing the tubing in two stages, and at different speeds while passing a medium therethrough under pressure until the medium reaches a preselected pressure.

2. Description of the Prior Art

In providing capillary tubes that meet the proper restriction requirements of a particular refrigeration system, it has been customary practice to purchase readily available tubing from standard stock having the smallest inside or bore diameter, and then cutting it to the length that would provide the proper restriction needed for a particular application.

While this practice does provide a capillary tube having effective flow characteristics, the proper flow restriction, however, is determined by the length of tubing and not by a predetermined passageway or inside diameter dimension. To accommodate the relatively long capillary provided in this manner into the available cabinet space, it is often necessary to coil or shape it. This coiling and handling of the tube presents some hazards in that the relatively small diameter passageway of the tubing may be pinched and closed off during the handling and shaping.

U.S. Pat. No. 2,225,513-Sommers discloses a method of forming restrictors wherein a relatively straight length of tubing is provided with longitudinally formed grooves that deform it cross-sectionally to initially reduce its passageway. The deformed tube is then twisted while being maintained in a straight longitudinal configuration. During the twisting operation a gas under constant pressure is passed through the tube with the twisting operation being terminated when the gas reaches a desired pressure. While the Sommers patent does provide a capillary having a predetermined length, it is, however, formed in a straight line and in some instances would require its shaping to fit its free ends into engagement with the appropriate tube members to complete its connection into the refrigeration system. In fact, unless the open ends of the refrigeration system to which the capillary is to be connected are spaced to receive the straight length of capillary formed by the Sommers patent, it must when completed be shaped either to fit into the available spaces or to align its ends with the proper refrigeration tube connections.

In forming standard tubing of preselected lengths into capillaries having a precise restriction, the time involved in forming them is extremely important when related to mass production systems. When tubing is formed in a slow continuous squeezing or forming operation until the proper restriction is achieved it has been found uneconomical in that mass production schedules and volume committments are difficult to maintain.

In forming capillaries from standard tubing, that is, tubing available as a stock item, the use of a single high speed continuous squeezing or forming operation has been found to be impractical in that the reaction time between the termination of a squeezing operation after the proper restriction is sensed or arrived at, is sufficient in some instances to cause an overshoot. This overshoot caused by the reaction time between the sensing of the proper restriction and the ability to stop a high speed machine results in an overly restricted tube or may in fact cause the passageway to be completely shut off, in which case it is then necessary as disclosed in U.S. Pat. No. 1,392,658-Roesch, to provide means and the additional step of reopening the closed passageway. To reopen the passageway and afford the precise slow characteristics required would present many of the same problems faced in prior art attempts and would not be economically feasible in meeting the mass production requirement.

In addition, it has been the experience in squeezing tubes with high speed equipment that the squeezed tube has a tendency to spring back. In effect, when a high speed operation or machine is brought to an abrupt stop at a precise preselected dimension the inability to accurately determine what the spring back qualities of the tube will be results in inaccurate restriction configuration.

SUMMARY OF THE INVENTION

By this invention there is provided a method of forming a capillary tube for connection into a refrigeration system. A length of tubing is formed longitudinally into a preselected configuration so that its free ends are adapted to be connected into the refrigeration system. A preselected portion of the formed tubing is placed in a two step forming mechanism. The tubing is then connected to a constant source of fluid whose pressure is recorded on a measuring device. An initial high speed squeezing operation crushes the tube to a predetermined passageway restriction, and a second slower squeezing operation crushes the tubing further until the medium passing through the tubing reaches a predetermined pressure, at which time the squeezing operation is terminated.

It is an object of the invention to provide an improved method of forming a capillary to be used in refrigeration systems.

It is another object of the method of this invention to produce a capillary from a standard readily available dimensioned tubing.

It is another object of the method of this invention to employ a high speed first squeezing operation which is effective in providing a restriction that is substantially complete and then employing a second low speed operation that continues squeezing the tube until the final design restriction is attained.

DESCRIPTION OF THE PREFERRED EMBODIMENT

Figure 1:
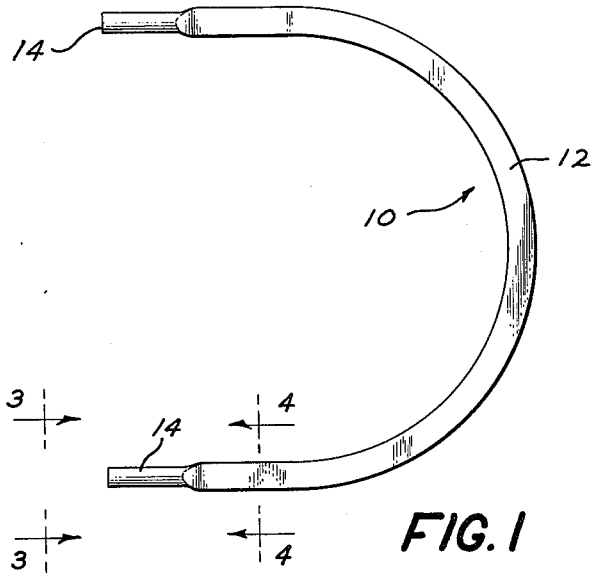
FIG. 1 is a plan view of the formed tubing incorporating the restriction formed by the method of the present invention.
Figure 3:
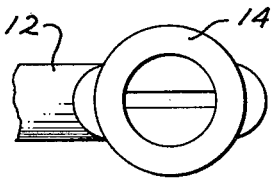
FIG. 3 is the end view of the tubing showing the preformed tube configuration.

Referring to the drawings and more particularly to FIG. 1, there is shown a capillary tube 10 formed in accordance with the method of the present invention. The finished tube 10 consists of a crushed or squeezed portion 12 including the restriction or capillary and end portions 14.

The tubing 10 employed in the present method is a standard stock item and has an outside diameter of approximately ¼ inch, a wall thickness of approximately 0.050 inch, it should be noted that tubing having other dimensions may be employed, however, the following description of the method of the present embodiment has been carried out with the above dimensioned tube stock.

Figure 2:
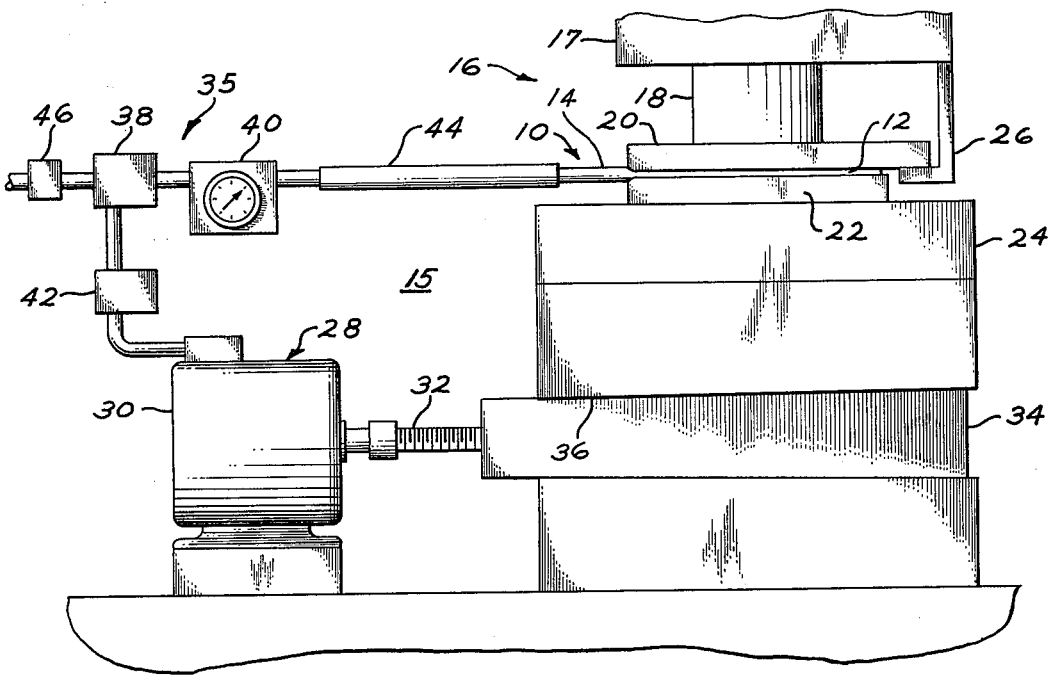
FIG. 2 is the mechanism used in carrying out the method of the present invention.

The present method of forming the capillary and restriction may be effected by several different mechanisms. One form of mechanism 15 for carrying out the steps of the method is shown in FIG. 2, wherein the mechanism includes a two step or operation, forming press 16 which may be of the hydraulic or direct mechanical drive type. The press 16 includes a primary or high speed section 17 which includes a forming ram 18 having a die plate 20 carried thereon. The die plate 20 is adapted to cooperatively engage with a matching die 22 supported on a table or anvil 24.

A stop means 26 is positioned so as to be engaged by the die 20 during its downward travel so that the movement of die 20 is arrested at a predetermined point relative to the anvil 24. Cooperating with the support table 24 is a secondary or slow speed squeezing means 28 for moving the die 22 toward the arrested die plate 20 located in engagement with the stop 26. The slow speed means 28 is employed to complete the forming operation of the restriction 12 of the tube 10 as will be hereinafter explained. To this end the secondary squeezing means 28 includes a drive member 30 which is connected to a wedged shaped member 34 through element 32. In operation, when the drive member 30 is activated it forces the member 34 through element 32 to the left in FIG. 2. Lateral movement of the member 34 is effective through its inclined surface 36 acting on a mating surface on table 24 to raise the due 22 thereon toward the stationary die plate 20. The element 32 may be driven laterally, or alternatively it may be a screw that is rotatably arranged between drive 30 and wedge 34 to laterally move the wedge member relative to the anvil 24. At the completion of the second squeezing operation the member 34 is returned to its normal position wherein the spacing of die 22 relative to the stop 26 is maintained.

In FIG. 2 there is also shown as a part of the mechanism 15 used in carrying out the present method, one control means or arrangement 35 for supplying fluid or air under pressure to the tube 10 to be formed and for controlling the operation of the steps of the present method. Fluid or air under regulated pressure is conducted from a source (not shown) to a common pressure regulator 46. The discharge side of the regulator 46 is connected to a pressure or flow switch 38. The rate of air flow may, as will be explained hereinafter, be preset and controlled by the flow switch 38. From the flow switch 38 air is directed to the tubing 10 to be formed through a gauge 40 which provides a visual indication of the fluid pressure.

The flow switch 38 is connected to the secondary squeezing mechanism 28 whose operation is initiated by the flow switch 38 after, as will be explained hereinafter, the capillary passageway is initially decreased by movement of ram 18 of the first or high speed squeezing operation.

Figure 5:
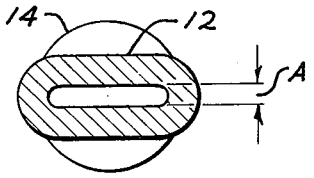
FIG. 5 shows the tube restriction at its intermediate stage.
Figure 4:
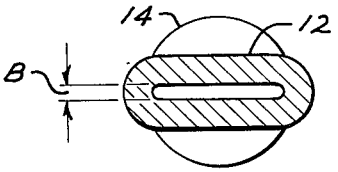
FIG. 4 is a view taken along lines 4—4 of FIG. 1 showing the tube restriction in its final form.

The flow switch 38 can be appropriately calibrated to initiate the second squeezing mechanism 28 when the pressure of the fluid in the tube restriction reaches a predetermined pressure between desired limits or, when the cross sectional area is dimensioned as shown in FIG. 5 as determined by the position of stop 26 relative to anvil 24. In either case at the completion of the first or high speed operation the restriction at that time is substantially complete as indicated by dimension "A" in FIG. 5 relative to dimension "B" in the final form shown in FIG. 4.

The starting and stopping of mechanism 28 may be determined by the predetermined pressure settings of the flow control switch 38 so that very exact passageway restrictions can be obtained, this is especially true as carried out in the present embodiment wherein the speed of the die 22 is between 0.001 and 0.010 inches per second.

It should be further understood that the second or slow speed stages of the squeezing operation may be a variable speed. For example, a servo mechanism 42 may be serially connected between the flow switch 38 and mechanism 28. The servo mechanism 42 would be effective to initiate mechanism 28 at a preselected speed at the start of the second operation and then be effective in slowing down the operation of the mechanism 28 from the preselected speed as the pressure in the tube restriction increases as the tubing approaches its designed constriction.

In carrying out the present method of forming capillaries, a preselected length of a tube section 10 is preshaped so that its free ends 14 are adapted to be connected into a refrigeration system, customarily intermediate the evaporator and condenser. While in FIG. 1 the formed tube is shown as being substantially U-shaped and relatively flat, or in a single plane, it should be noted that various other shapes and configurations are adaptable in carrying out the present method.

In preforming the tube 10 it is, however, necessary that at least one relatively flat portion or section having its axis in a single plane be provided that may be conveniently arranged between dies 20 and 22 and subsequently formed or squeezed to provide the restriction in accordance with the present method. In effect the axis of the portion of the tube 10 exterior of section 12 to be formed with the capillary may be angled laterally therefrom in any convenient direction that may be necessary to adapt the tube 10 into an available area.

After the tube 10 is preformed or shaped as mentioned hereinbefore, the flat portion or area 12 thereof to be squeezed is arranged between the dies 20, 22 of the press 16. One of the free ends 14 of tube 10 is then connected to the control means 35 through a conduit 44. With section 12 of the tube 10 so positioned, the high speed section 17 of press 16 is activated to initiate the first squeezing step so that ram 18 and its die 20 is moved rapidly toward die 22 until it is arrested by stop means 26. At the completion of the first squeezing operation the second slower squeezing operation may be initiated, and then terminated by flow switch 38 when a predetermined pressure flow is measured to complete the forming of the restriction.

While, as mentioned hereinbefore, it is not desirable to form the restriction by a high speed squeezing operation because of the difficulty in controlling a high speed press, it is, however, advantageous to use a high speed squeezing operation to bring the restriction relatively close to the final design dimension so that the final or slow speed squeezing operation or movement of die 22 requires a minimum amount of travel and as a result the total forming operation of the capillary time is held to a minimum.

It should be noted that the first or high speed squeezing operation may be terminated by flow switch 38 of the control means 35 similar to the second or slower operation when the pressure flow through the tube reaches a first predetermined pressure, at which time the second or slow speed squeezing operation may be initiated by control means 35 as mentioned hereinabove. This second or slow speed operation would then continue until the pressure flow through the tube reaches a second predetermined pressure, at which time the flow switch 38 terminates operation of the mechanism 15.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. The method of forming a capillary tube for connection into a refrigeration system which comprises:

forming a length of tubing longitudinally into a preselected configuration so that the free ends thereof are arranged to connect with said refrigeration system, including at least one portion intermediate said ends being in a single plane;

placing said portion of said tubing intermediate said free ends in a forming means;

connecting at least one of said free ends to a source of constant pressure through a control means having means for measuring said pressure passing through said tubing;

squeezing said portion of the tubing in the forming means at a first speed until the tubing reaches an intermediate predetermined restriction; then squeezing said portion of tubing at a second slower speed until the tubing restriction causes the medium passing through said tubing to reach a final predetermined pressure; and terminating said second squeezing operation when said measuring means indicates said predetermined pressure.

2. The method of claim 1 wherein said intermediate predetermined restriction is between 90 and 99% of final predetermined restriction.

* * * * *